US008584886B1

(12) United States Patent
Ellman et al.

(10) Patent No.: US 8,584,886 B1
(45) Date of Patent: Nov. 19, 2013

(54) GARBAGE CONTAINER WITH DETACHABLE MANUAL COMPACTION DEVICE

(76) Inventors: Peter Ellman, Carlsbad, CA (US); John H. Hyle, Carlsbad, CA (US)

( * ) Notice: Subject to any disclaimer, the term of this patent is extended or adjusted under 35 U.S.C. 154(b) by 0 days.

(21) Appl. No.: 13/470,247

(22) Filed: May 11, 2012

(51) Int. Cl.
*B65D 43/26* (2006.01)
*B30B 15/06* (2006.01)

(52) U.S. Cl.
USPC ..... 220/260; 220/263; 220/262; 220/770; 100/295; 100/265; 100/227; 100/245; 100/214

(58) Field of Classification Search
USPC ..... 220/263, 770, 254.3, 578; 100/229 R, 100/58
See application file for complete search history.

(56) References Cited

U.S. PATENT DOCUMENTS

| | | | | |
|---|---|---|---|---|
| 2,419,163 | A * | 4/1947 | Pope, Sr. | 220/23.87 |
| 2,465,839 | A * | 3/1949 | Bloomfield | 100/228 |
| 2,910,206 | A * | 10/1959 | Hodgson | 220/23.87 |
| 3,863,563 | A * | 2/1975 | Popeil | 100/102 |
| 4,050,373 | A * | 9/1977 | Hellmann | 100/240 |
| 4,331,074 | A | 5/1982 | Behman | |
| 4,416,197 | A * | 11/1983 | Kehl | 100/214 |
| 4,593,615 | A | 6/1986 | Kehl | |
| 4,658,720 | A * | 4/1987 | Massonnet | 100/226 |
| 5,090,309 | A * | 2/1992 | Lai | 100/226 |
| 5,730,047 | A | 3/1998 | Lindsey | |
| 6,851,357 | B1 | 2/2005 | Martorella | |
| 6,889,604 | B2 * | 5/2005 | Ernst | 100/226 |
| 6,910,412 | B2 | 6/2005 | Ko | |
| 7,237,480 | B2 | 7/2007 | Ruddock | |
| 7,255,244 | B2 * | 8/2007 | Miller | 220/578 |
| 7,490,545 | B2 | 2/2009 | Baghdoian | |
| 7,874,446 | B2 | 1/2011 | Spivey | |
| 7,950,325 | B2 | 5/2011 | Kachkovsky | |
| 7,997,191 | B2 | 8/2011 | Chrysson | |
| 8,001,887 | B2 | 8/2011 | Harari | |
| 8,141,481 | B2 * | 3/2012 | Forbes | 100/233 |
| 8,156,863 | B1 * | 4/2012 | Wilson | 100/226 |
| 2010/0181313 | A1 | 7/2010 | Turina | |
| 2011/0056393 | A1 * | 3/2011 | Kachkovsky | 100/45 |

* cited by examiner

*Primary Examiner* — Mickey Yu
*Assistant Examiner* — Gideon Weinerth

(57) ABSTRACT

A self-contained garbage or trash container system with an integrated removable, manual compaction device designed primarily for home or industrial use. The system includes an outer receptacle with attached hinged lid; an internal receptacle; a compaction device; and an attachment mechanism integrated into the lid and/or the compaction device as part of the system to house compaction device.

11 Claims, 7 Drawing Sheets

GARBAGE CONTAINER WITH DETACHABLE MANUAL COMPACTION DEVICE

This is related to U.S. Provisional Application Ser. No. 61/518,808 filed on May 12, 2011.

BACKGROUND OF THE INVENTION

1. Field of Invention

The present disclosure relates to improved garbage container systems and compaction devices in the household and industrial settings. More specifically the present disclosure relates to a garbage container system that includes a free-floating, self-contained, removable, manual compaction device.

2. Description of the Related Art

Garbage or trash containers are well-known devices used to dispose of various kinds of waste. There are many names for these containers—"garbage cans," "trash cans," "refuse containers," "dustbins," etc. . . . . Trash containers range from general disposal containers to those with specified use. Handling of waste can be a messy and tedious chore. Furthermore, waste disposal has strong environmental impacts as our landfills are filling, and we recognize that there is a finite amount of resources available. Compacting or compressing trash is favored for environmental and economic reasons (e.g. reducing the number of trash bags needed in a household). Compacting trash serves to reduce the number of times waste receptacles are emptied; it allows more waste to be stored in smaller space; and is generally something that is done (at some level), even when waste is thrown out (e.g. pushing paper down into a waste basket). Many people resort to using their hands or feet to compact the trash. In addition to being potentially very unpleasant, it can be unsanitary and expose the individual to waste, and potential injury from waste products. Alternatively, several types of devices have been developed to reduce the size and amount of waste in a container by compressing or compacting the trash—specifically trash compactors. There are motorized trash compactors and manual compactors.

Trash compactors are known in the art. Previous trash compactors include complex mechanical, hydraulic or electrical systems. Motorized compactors have not been able to fulfill the need for compaction effectively. They are noisy, bulky, expensive, and have a small range of power settings. Furthermore, they are usually built-in appliances, difficult to transport from one location to another, and may not be practical for outdoor use. Furthermore, the need for power limits where and how a motorized device can be used.

Manual compactors are also known in the art. However, a majority of the designs are complex, with several component parts that may break or create an awkward design for subtle, inconspicuous home storage of waste receptacles preferred by most users. In several prior art examples, compression devices require external levers or other means of assisting in compaction, requiring additional screws or component parts (and more means of potentially breaking). In another prior art example, the compactor device is integrated into a large triangular shape that would not easily be tucked into or under a cabinet, as many users would prefer. Additionally, many prior-art manual compactors are bulky, difficult to clean, and awkward to store.

A free-floating compaction element integrated into the lid of a garbage container will help with certain issues, including aesthetic issues. In yet a more recent prior art example, baffles are integrated into the lid of the system. However, foodstuffs and other dirt particles can accumulate in the baffles (and may be potentially unsanitary and difficult to clean). Furthermore, the baffle has a limited range of compression, greatly minimizing its compaction effectiveness.

Another prior art example contemplates a handheld version of a manual compactor. While this allows the compactor to be used in multiple devices, it does not take into consideration users preferences for self-contained storage—particularly since compaction involves waste and waste products. Furthermore, the problems of "slippage" of internal plastic bags should be taken into account.

Users will continue to seek new, innovative, clean, safe, economical, environmentally sound home garbage container systems.

BRIEF SUMMARY OF THE INVENTION

The present invention includes a garbage container system that has an integrated yet free-floating lightweight, removable manual compaction device. The compaction device is housed in the lid of the exterior trash container and is easily removable. The present invention solves the problems that still exist with trash container systems by providing the user with an aesthetically pleasing, efficient, effective and easy to store in a cabinet or other discreet place garbage container. Since the compaction device is housed within the lid of the exterior trash receptacle, and is carefully sized to fit the internal receptacle, the user has full range of motion with the compaction device without subjecting body parts or clothing to contact with the waste. The compaction device covers nearly the entire internal area of the receptacle, maximizing amount of trash compaction and minimizing external mess. Furthermore, due to its design, the compaction device may be used with other waste containers to compact additional trash (separate from its original trash container system); but can still be easily stored within the original system. It is easy to clean; to maximize cleanliness, the compaction device may be cleaned in the kitchen sink with soap and warm water.

One embodiment of the present invention is a garbage container system having an exterior garbage container; an interior garbage receptacle; a defining central opening in the lid of the exterior container, sufficiently wide to accommodate a full-grown adult hand and arm; and an attachment mechanism by which a manual compaction device is integrated into the garbage container system. The attachment mechanism having a plurality of fastening devices secured to the top of the compaction device and to the underside of the lid (of the exterior garbage container) in order to secure the compaction device in place when it is not being used. One such means of attachment is magnets or other ferrous material.

In another embodiment of the present invention, attachment mechanism is an adhesive or adhesive-like substance.

In yet another embodiment of the present invention, the attachment mechanism is an interlocking means such as a snap-fit. In this particular embodiment, the interlocking means is integrated into the exterior garbage container lid utilizing a protruding portion into a receiving portion.

In still another embodiment of the present invention, the attachment mechanism includes snaps or snap-like connectors, adhering to the underside of the lid (of the exterior garbage container) by rod; adhesive; or other like means.

In another embodiment of the present invention, the defining central opening in the lid of the exterior container has an oval or round shape.

In still another embodiment of the present invention, the defining central opening in the lid of the exterior garbage container is rectangular in shape.

In yet another embodiment of the present invention, the defining central opening in the lid of the exterior garbage can has a shape that includes three straight sides; rounded corners; and a curved front portion following along the front portion of the lid of the exterior container.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
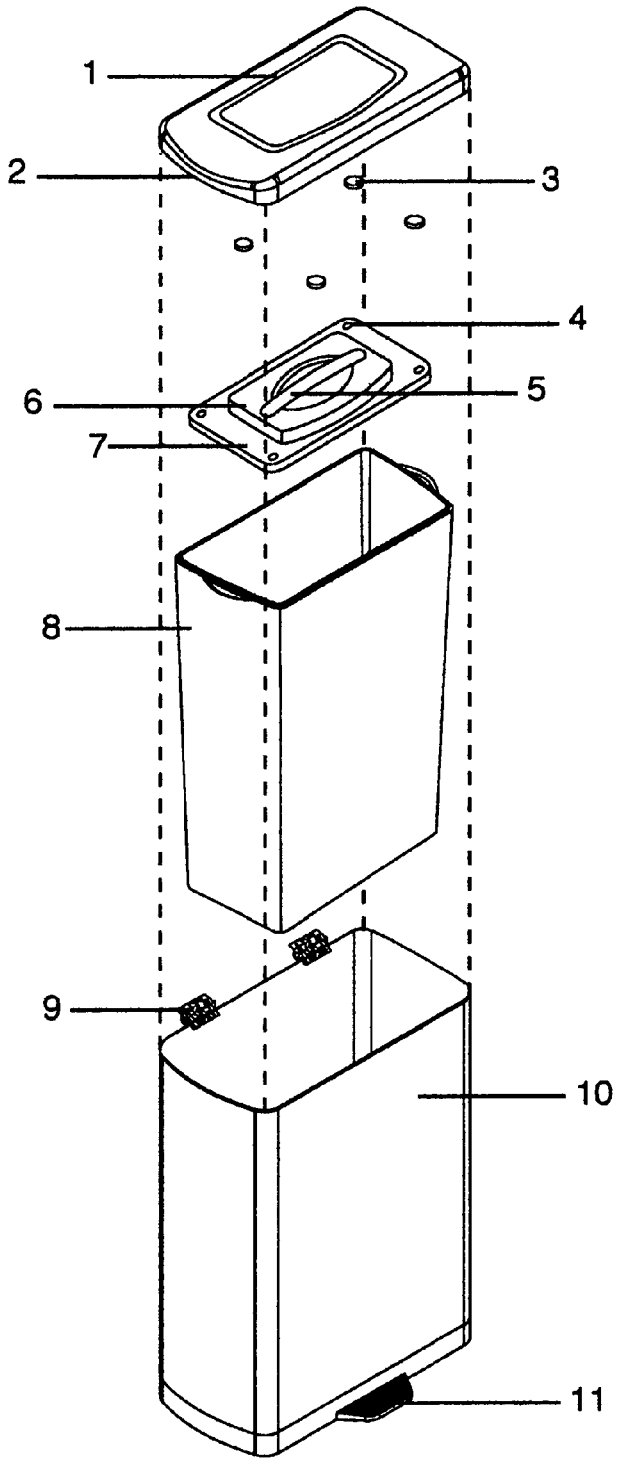
FIG. 1 is an exploded view of the garbage container system, in a version utilizing a plurality of magnets as the attachment mechanism.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

The present invention contemplates a garbage container system with a free-floating integrated compaction device.

Figure 1A:
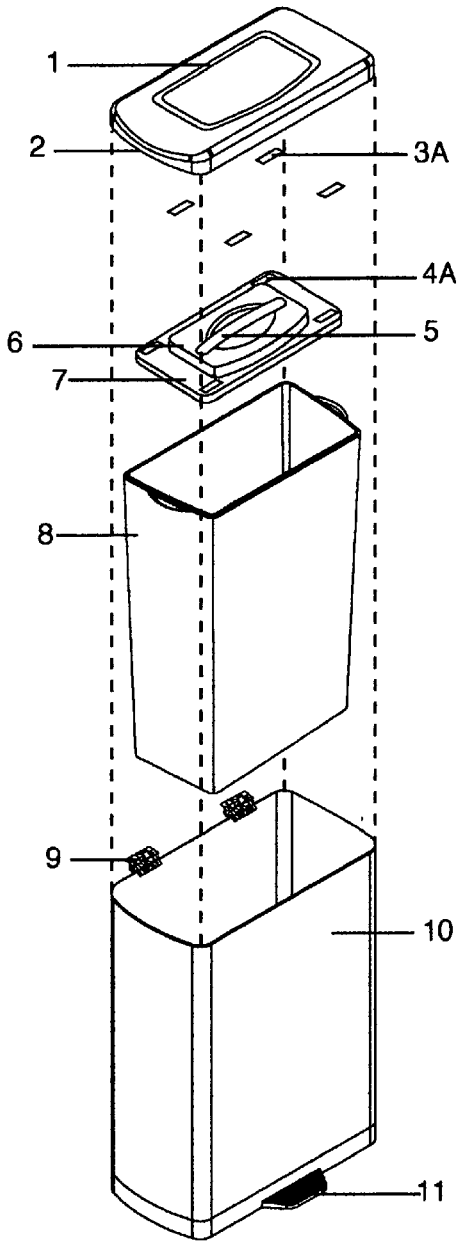
FIG. 1A is an exploded view of the garbage container system, in a version utilizing adhesives or adhesive-likes substance as the attachment mechanism.
Figure 1B:
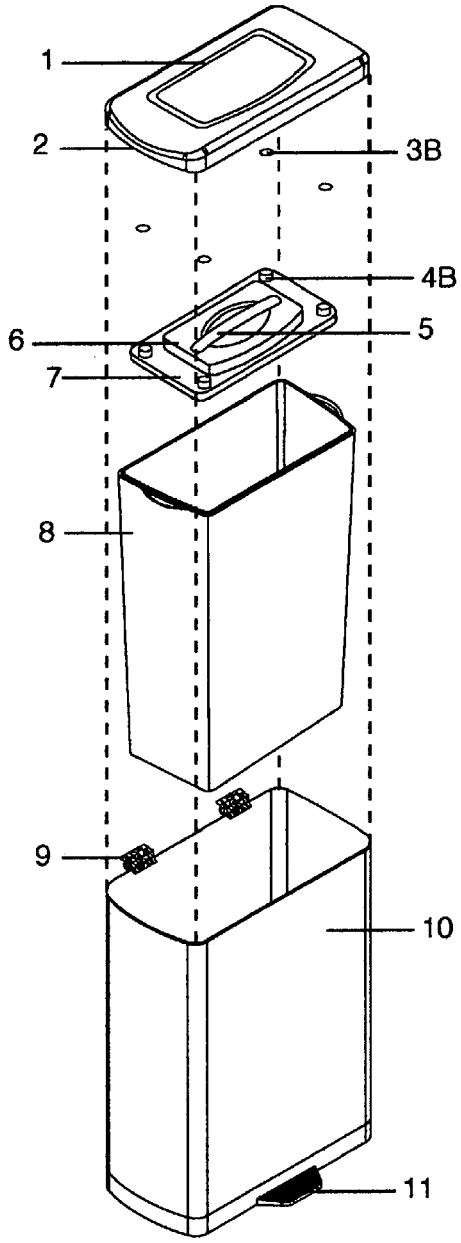
FIG. 1B is an exploded view of the garbage container system, in a version utilizing an interlocking mechanism or snap-fit with protruding portions and receiving portions as the attachment mechanism.
Figure 1C:
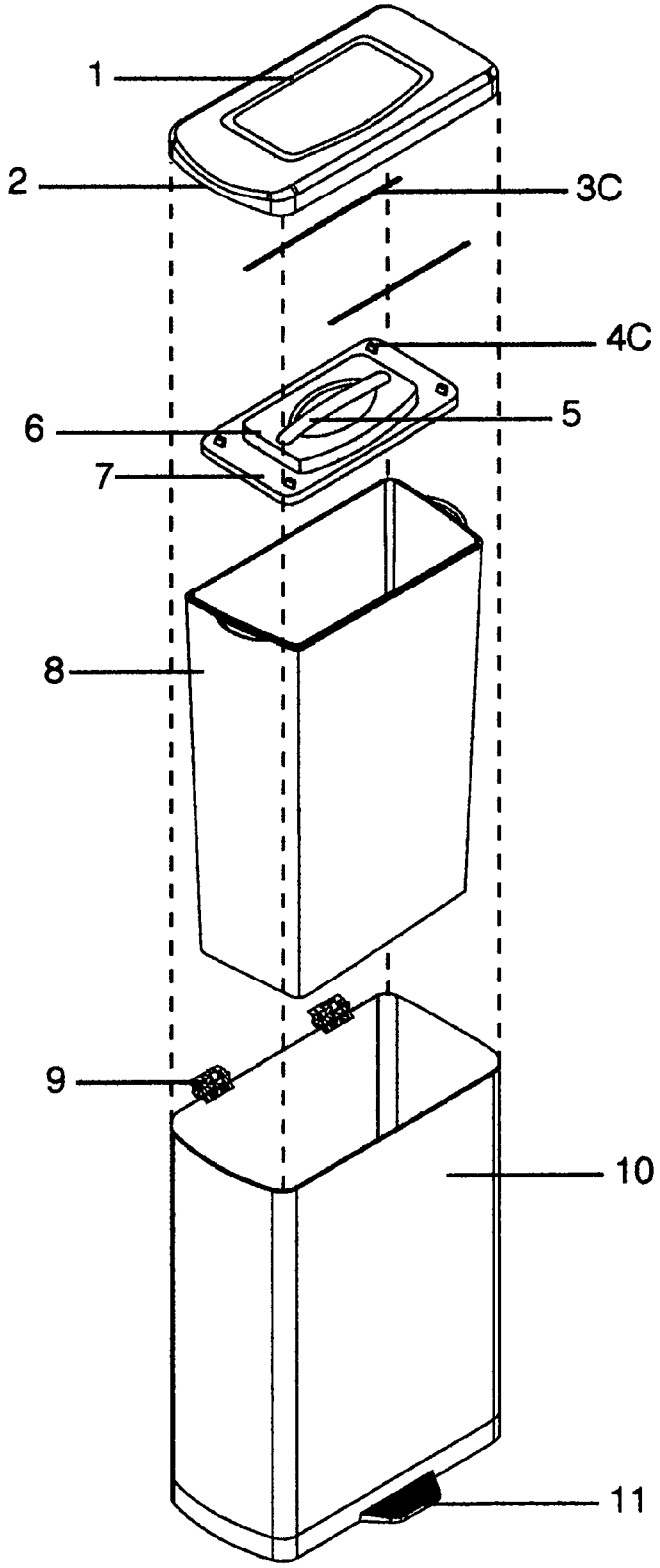
FIG. 1C is an exploded view of the garbage container system, in a version utilizing a receiving rod or adhesive (which adheres to the inside of the lid) and snaps or snap-like materials which connect or lock into the receiving rods or adhesive and serves as the attachment mechanism.

Referring to the figures, and in particular FIGS. 1-1C, there are illustrated variations of a garbage container system with an integrated manual compaction device (see, e.g., FIG. 4), the compaction device having a handle 5, a top 6, and a bottom 7. The handle 5 is part of top 6. However, one skilled in the art would appreciate that a handle 5 may be a separate piece subsequently welded, screwed, or otherwise attached securely to top 6. The garbage container system has an external garbage receptacle (exterior body defining chamber with an open end) 10, said external garbage receptacle having hinges 9, a lid 2 and a foot pedal 11 at the base of exterior garbage receptacle 10. When depressed, foot pedal 11 opens lid 2. In a preferred embodiment, the external garbage receptacle 10 consists of stainless steel. However, one skilled in the art would appreciate that a trash receptacle may be made of many different materials. The garbage container system also includes an internal receptacle 8. Internal receptacle 8 may be a heavy-duty plastic, rubber or combination of materials (synthetic and/or natural). One skilled in the art would appreciate that there are a variety of materials that can make up internal receptacle 8.

Lid 2 contains a defining central opening 1 wherein the compaction device is integrated into the lid 2, with attachment mechanisms 3,4 securing compaction device bottom 7 to the interior of the lid 2, the compaction device top 6 resting flush with lid 2 and handle 5 of the compaction device protruding through lid 2. Defining central opening 1 should be large enough to allow an adult hand and arm to actuate the manual compaction device. Defining central opening 1 may be a variety of shapes (depending, in part, on the shape of the manual compaction device) including, but not limited to, circular, oval, rectangular, may include a shape consisting of three straight sides with rounded corners and a curvature along the front side of lid 2 (opposite hinges 9), or any other alternative variation of shape designed to permit a user to actuate the manual compaction device.

In a preferred embodiment of the present invention as shown in FIG. 1, the attachment mechanism 3, 4 is a plurality of magnetic fastening devices 3 located on the underside of lid 2 and a plurality of magnetic fastening devices 4 secured to the bottom 7 of the compaction device. One skilled in the art would recognize that there are natural variations using magnets and ferrous material in order to secure the compaction device to the underside of lid 2 when not in use, but to allow the release of the manual compaction device when adequate pressure was applied to the handle 5 to engage in manual compaction.

In an alternative embodiment of the present invention as shown in FIG. 1A, the attachment mechanism 3A, 4A is an adhesive or adhesive-like substance wherein one portion of the adhesive substance(s). One skilled in the art would recognize that there are a multitude of adhesive substances (such as, but not limited to a Velcro) that would serve as the attachment mechanism 3A, 4A. Furthermore, one skilled in the art would understand that certain adhesives (such as a glue or glue-like substance with a single adhesive contact point) could be placed on the underside of the lid 2 (at 3A) and/or on the bottom 7 (at 4A) of the compaction device.

In another alternative embodiment of the present invention as shown in FIG. 1B, the attachment mechanism 3B, 4B is interlocking mechanism protruding portions 4B located on compaction device bottom 7 and receiving portions 3B located on the underside of lid 2. One skilled in the art would appreciate that there are several variations of interlocking mechanisms, including, but not limited to, snap-fits.

FIG. 1C is another alternative embodiment of the present invention wherein the attachment mechanism 3C, 4C is a receiving rod or adhesive 3C located on the underside of lid 2 and snaps or snap-like materials 4C located on compaction device bottom 7. The attachment mechanism in the above-mentioned examples keeps the compaction device in place when not in use. Specifically, the attachment mechanism(s) secures the manual compaction device to the underside of the lid 2 of the external garbage receptacle 10.

Figure 2:
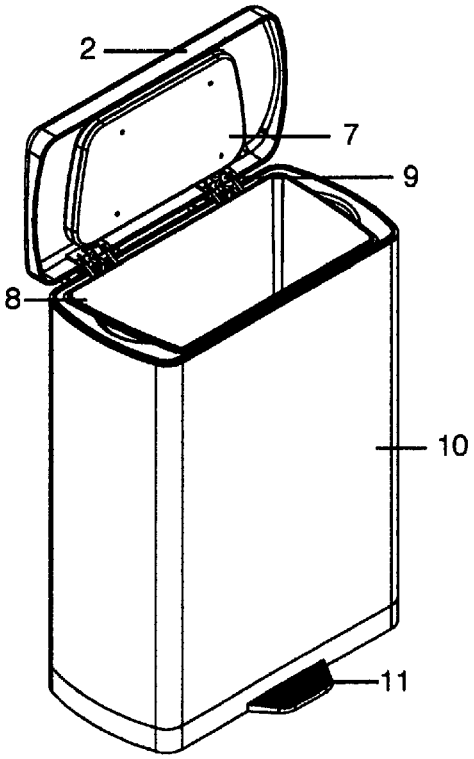
FIG. 2 is a partial side view, with an open lid, of the garbage container system.
Figure 3:
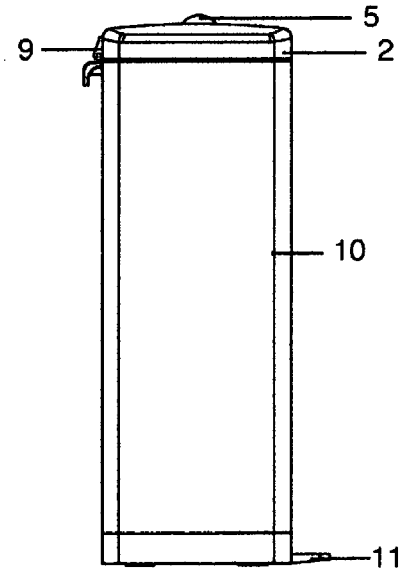
FIG. 3 is a side view of the garbage container system.

FIG. 2 and FIG. 3 show alternative views of a preferred embodiment of the present invention. FIG. 2 shows a partial side view of exterior garbage receptacle 10, in which foot pedal 11 as engaged hinges 9 to open lid 2. The compaction device is seen at rest in its housing in lid 2, with the bottom 7 of the compaction device most visible with only a small portion of compaction device top 6 visible, as compaction device top 6 is now flush with the lid 2. Interior garbage receptacle 8 rests in exterior garbage receptacle 10. One skilled in the art would appreciate that while one shape is shown in the figure, a variety of shapes may be used for exterior garbage receptacle 10 and interior garbage receptacle 8.

FIG. 3 shows a side view of a preferred embodiment of the present invention. Compaction device handle 5 protrudes through lid 2 at the defining central opening (not visible in this figure). This figure further shows hinge(s) 9 and foot pedal 11.

Figure 4:
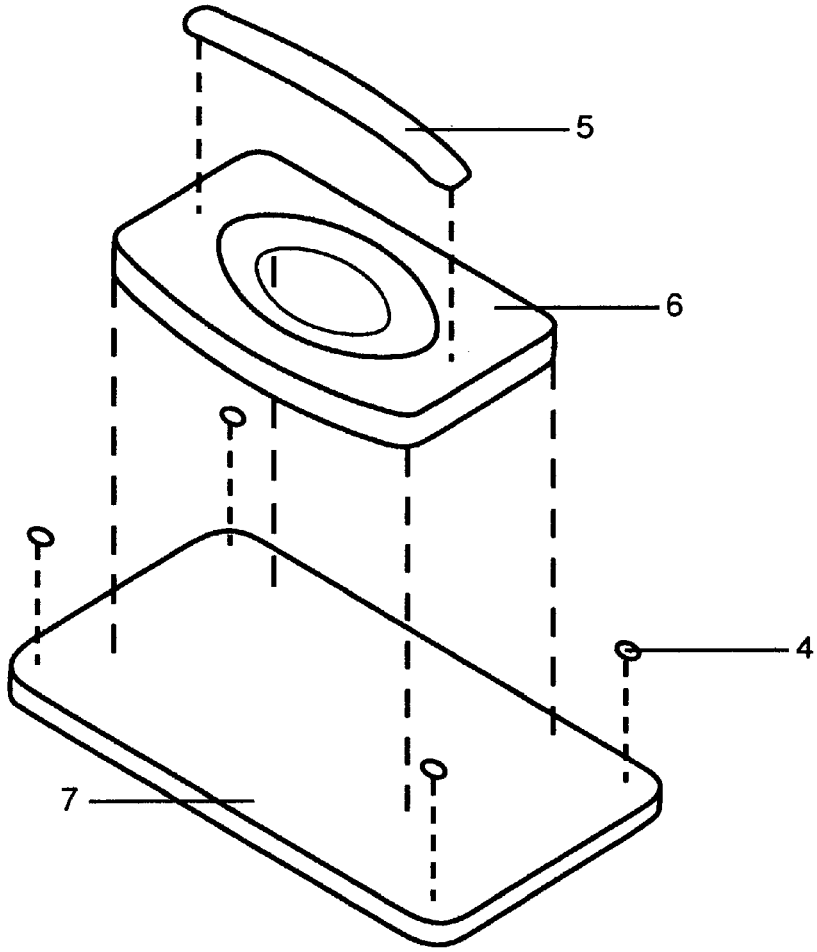
FIGS. 4-4C are exploded views of the compaction device (with different attachment mechanisms).
Figure 4A:
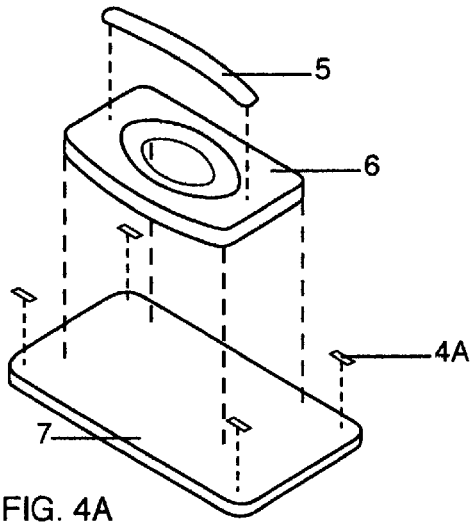
Figure 4C:
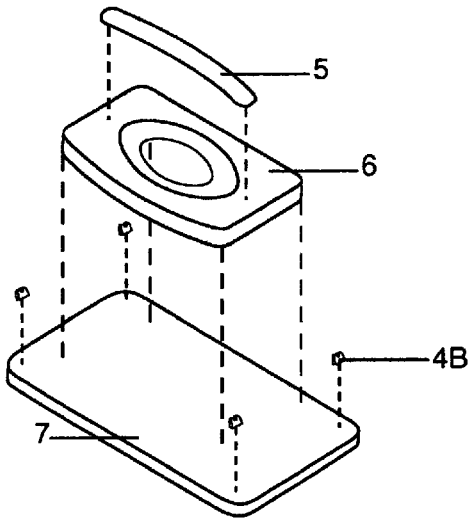
Figure 4B:
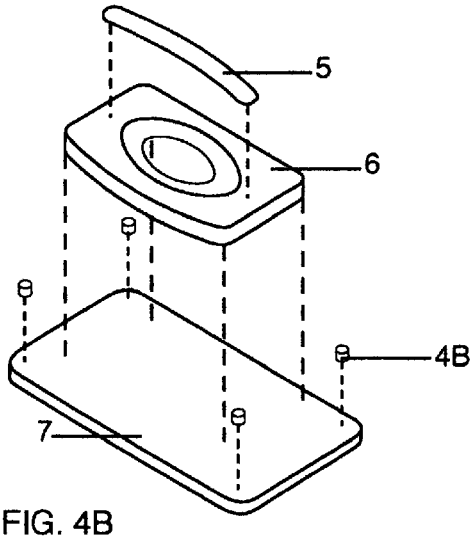

FIGS. 4, 4A, 4B and 4C are illustrated variations of the manual compaction device. The manual compaction device consists of a handle 5, top 6, and base 7. The figures show the portion of the attachment mechanism located on the compaction base 7. FIG. 4 illustrates the plurality of magnets 4; FIG. 4A illustrates an adhesive 4A; FIG. 4B illustrates the protruding portion 4B of an interlocking mechanism; and FIG. 4C illustrates a snap or snap-like mechanism 4C. One skilled in the art would appreciate that this is not an exhaustive listing of potential attachment mechanisms, but would rather understand that these samples are intended to be representative of alternative variations of attachment mechanisms. Additionally, one skilled in the art would understand that each attachment mechanism described may belong to a class of attachment mechanisms and that the present invention further contemplates the use of attachment mechanisms in those classes (and not just the singular example illustrated in the figures).

Figure 5:
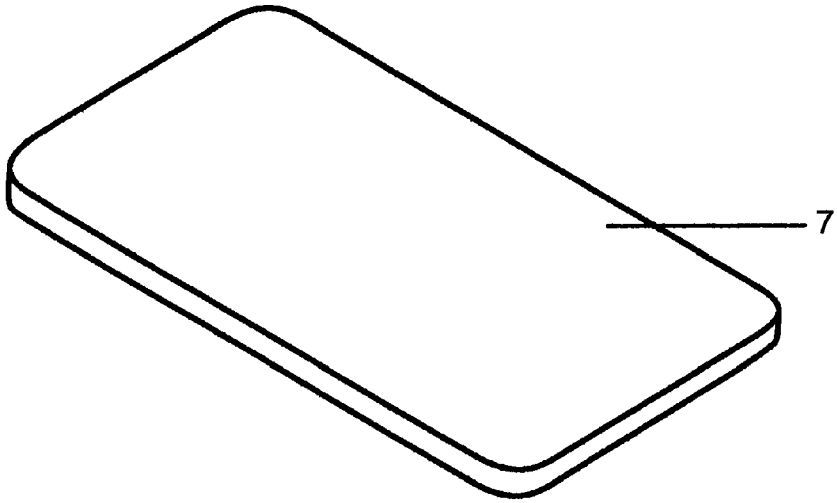
FIG. 5 is a bottom or underside view of the compaction device.
Figure 6:
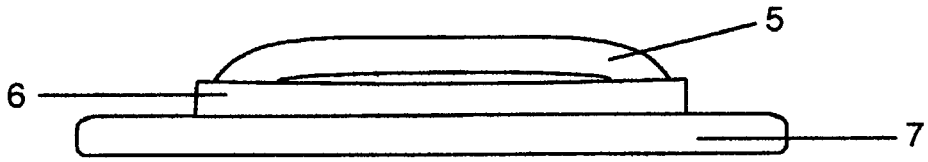
FIG. 6 is a side view of the compaction device.

FIG. 5 is a view of the bottom 7 of the compaction device while FIG. 6 presents a side view to better help one skilled in the art appreciate the component parts (handle 5, top 6, and bottom 7) of the free-floating manual compaction device.

From the foregoing it will be observed that numerous modifications and variations can be effectuated without departing from the proper scope and fair meaning of the novel concepts of the present invention. It is to be understood that no limitation with respect to the specific embodiment(s) illustrated is intended or should be inferred. It will be appreciated that the invention is susceptible to modification, variation and change without departing from the proper scope and fair meaning of the accompanying claims.

What is claimed is:

1. A garbage container, comprising:

an exterior body defining a chamber with an open end;

a lid attached by one or more hinges to the exterior body adjacent to the open end and having a central opening defined therein;

a foot pedal attached at the base of the exterior body which when depressed opens the lid;

an interior chamber with an open end placed within the exterior body;

a removably attached manual compaction device comprising a generally flat base, a top, a handle and an attachment mechanism by which the manual compaction device is integrated into the lid of the garbage container, wherein the base of the compaction device is secured by the attachment mechanism to the inside of the lid, whereby the top of the compaction device is flush with the lid, and the compaction device handle protrudes above the lid at the defining central opening;

wherein the attachment mechanism is selected from the group consisting of a plurality of magnetic fasteners or adhesives.

2. The garbage container of claim 1 wherein the defining central opening is oval shaped.

3. The garbage container of claim 1 wherein the defining central opening is rectangular shaped.

4. The garbage container of claim 1 wherein the defining central opening is a shape consisting of three straight sides with rounded corners and a fourth side that is curved.

5. The garbage container of claim 1 wherein the hinges permit the lid to create an angle of ninety degrees or greater but less than one hundred and eighty degrees from the exterior body.

6. The garbage container of claim 1 wherein the attachment mechanism is magnets.

7. The garbage container of claim 1 wherein the magnetic fasteners comprises a plurality of magnets and ferrous materials.

8. The garbage container of claim 1 wherein the attachment mechanism is an adhesive.

9. The garbage container of claim 1 wherein the attachment mechanism is an interlocking mechanism.

10. A garbage container, comprising:

an exterior body defining a chamber with an open end;

a lid attached by one or more hinges to the exterior body adjacent to the open end and having a central opening defined therein;

a foot pedal attached at the base of the exterior body which when depressed opens the lid;

an interior chamber with an open end placed within the exterior body;

a removably attached manual compaction device comprising a generally flat base, a top, a handle and an attachment mechanism by which the manual compaction device is integrated into the lid of the garbage container, wherein the base of the compaction device is secured by the attachment mechanism to the inside of the lid, whereby the top of the compaction device is flush with the lid, and the compaction device handle protrudes above the lid at the defining central opening;

wherein the attachment mechanism is a plurality of interlocking snap-fit mechanical fasteners which comprises a plurality of receiving rods secured to the interior of the lid, the rods consisting of receiving portions of a snap-like mechanism, and protruding portions of a snap-like mechanism are secured to the top of the compaction device, whereby the receiving portions are engaged when the compaction device is integrated into the lid at the defining central opening.

11. A garbage container, comprising:

an exterior body defining a chamber with an open end;

a lid attached by one or more hinges to the exterior body adjacent to the open end and having a central opening defined therein;

a foot pedal attached at the base of the exterior body which when depressed opens the lid;

an interior chamber with an open end placed within the exterior body;

a removably attached manual compaction device comprising a generally flat base, a top, a handle and an attachment mechanism by which the manual compaction device is integrated into the lid of the garbage container, wherein the base of the compaction device is secured by the attachment mechanism to the inside of the lid, whereby the top of the compaction device is flush with the lid, and the compaction device handle protrudes above the lid at a defining central opening;

wherein the attachment mechanism comprises snaps wherein receiving portions of snaps, secured to the interior of the lid by adhesives, which attach to a set of corresponding protruding portions of snaps, secured to the compaction device by adhesives.

* * * * *